US010575704B2

(12) United States Patent
LeCompte et al.

(10) Patent No.: US 10,575,704 B2
(45) Date of Patent: Mar. 3, 2020

(54) WRINGER FOR MOPS, INCLUDING FLAT MOPS AND STRING MOPS

(71) Applicant: MICRONOVA MANUFACTURING, INC., Torrance, CA (US)

(72) Inventors: Phillip LeCompte, Anaheim, CA (US); Kristin Stewart, Harbor City, CA (US)

(73) Assignee: MICRONOVA MANUFACTURING, INC., Torrance, CA (US)

( * ) Notice: Subject to any disclaimer, the term of this patent is extended or adjusted under 35 U.S.C. 154(b) by 608 days.

(21) Appl. No.: 15/102,870

(22) PCT Filed: Dec. 3, 2014

(86) PCT No.: PCT/US2014/068464
§ 371 (c)(1),
(2) Date: Jun. 8, 2016

(87) PCT Pub. No.: WO2015/085016
PCT Pub. Date: Jun. 11, 2015

(65) Prior Publication Data

US 2016/0309980 A1 Oct. 27, 2016

Related U.S. Application Data

(60) Provisional application No. 61/911,112, filed on Dec. 3, 2013.

(51) Int. Cl.
*A47L 13/59* (2006.01)
*A47L 13/20* (2006.01)

(52) U.S. Cl.
CPC ..... *A47L 13/59* (2013.01); *A47L 13/20* (2013.01)

(58) Field of Classification Search
CPC ..... A47L 13/59; A47L 13/58
(Continued)

(56) References Cited

U.S. PATENT DOCUMENTS 150,269 A * 4/1874 White ..... A47L 13/59 15/261
551,355 A * 12/1895 Archer ..... A47L 13/59 15/261

(Continued)

FOREIGN PATENT DOCUMENTS

EP 1036538 9/2000

OTHER PUBLICATIONS

Eckenschwiller, A., European Search Report, dated Jul. 14, 2017, 6 pages, European Patent Office, Munich, Germany.

(Continued)

*Primary Examiner* — Laura C Guidotti
(74) *Attorney, Agent, or Firm* — Henricks Slavin LLP

(57) ABSTRACT

A wringer, for example for mops, includes one or more positioning elements to position a mop at least in one dimension in the wringer, for example to a desired depth in the wringer, to wring the mop. The positioning elements far other than a bottom surface of the wringer. A wringer is also disclosed in which a wringing surface is moved toward another wringing or a base surface in a drawing or pulling motion. A wringer is also disclosed where the wringing operation can be activated by a pivoting or other mechanism that can be operated from at least two positions, a plurality of spaced apart locations, from handles, or by way of structures positioned outside of a wringing envelope defined by wringing plates or other components contacting a mop element. The structures can be used to operate the wringer even if a handle of a mop element extends outward of the wringing envelope.

47 Claims, 6 Drawing Sheets

(58) Field of Classification Search
USPC ..... 15/261
See application file for complete search history.

(56) References Cited

U.S. PATENT DOCUMENTS

| | | | | |
|---|---|---|---|---|
| 943,650 | A | 12/1909 | Callis et al. | |
| 1,871,903 | A * | 8/1932 | Neldner | A47L 13/59 15/261 |
| 5,070,574 | A | 12/1991 | Delmerico et al. | |
| 5,615,446 | A | 4/1997 | Cetnarowski | |
| 6,996,873 | B2 * | 2/2006 | Salmon | A47L 13/59 15/260 |
| 7,383,604 | B2 | 6/2008 | Young | |
| 2002/0073502 | A1 | 6/2002 | Gromnicki | |
| 2005/0204503 | A1 | 9/2005 | Burns | |
| 2005/0262656 | A1 | 12/2005 | Van Landingham | |
| 2006/0085939 | A1 | 4/2006 | Petner | |

OTHER PUBLICATIONS

Hong, Y. International Search Report, dated Mar. 5, 2015, 8 pages, Australian Patent Office, Woden, Australia.
Hong, Y. International Written Opinion, dated Mar. 5, 2015, 6 pages, Australian Patent Office, Woden, Australia.

* cited by examiner

WRINGER FOR MOPS, INCLUDING FLAT MOPS AND STRING MOPS

CROSS REFERENCE TO RELATED APPLICATIONS

This application is a National Stage of International Application No. PCT/US14/68464, filed Dec. 3, 2014, and published as WO2015/085016, which claims priority to provisional patent application 61/911,112 filed Dec. 3, 2013, the entire contents of all of which are incorporated herein by reference.

BACKGROUND

Field

A wringer can be used for flat mops and string mops, and other mops and other articles.

SUMMARY

A wringer for mops can be used with flat mops, string mops, other mops and loose or miscellaneous materials such as wipes, and the like. In one configuration, the wringer can accept and reliably wring a flat mop. Flat mops typically have a relatively consistent thickness laterally and forward and backward from a mop handle attachment area, and may be more difficult to wring uniformly across the mop head. In one example of a wringer, positioning elements, posts, bosses or other locating devices can be used to position a flat mop at least in one dimension in the wringer, for example to a desired depth in the wringer, to wring the mop. The positioning elements are other than at the bottom of the wringer. For lateral positioning, the positioning elements are other than the lateral extremes of the interior of the wringer. This may be desirable, for example, in press wringers, including, for example, wringers in which one or several plates or wringing surfaces move toward another surface in an arcuate motion to press the mop head.

In another example of a wringer, for example a press wringer, a wringer can accommodate flat mops, as well as string mops and other nonuniform mop geometries and accomplish the desired wringing with flat wringing surfaces, and sufficient spacing between wringer surfaces to receive and wring non-uniform geometries such as string mops, miscellaneous materials, and the like. The spacing between wringer surfaces and a depth of a cavity between wringing surfaces may be selected so as to accommodate both flat mops and string mops.

In another example of a wringer, a press wringer can be configured to move a wringing surface toward another wringing or base surface in a drawing or pulling motion. A drawing or pulling motion for a wringing surface allows for stability and reliable pressing action in a wringer assembly. Additionally, wringing action can be activated or actuated by an external mechanism outside an envelope or active wringing area of a wringer. In a further example, a wringing mechanism can be actuated or activated by a pivoting, or other mechanism that can be operated from at least two positions. In one example, the wringing action can be activated or actuated at a plurality of spaced apart locations, for example at opposite ends of an axis, or shaft. In another example, a wringing action can be actuated or activated by one or more of a plurality of handles. In a further example, a wringing mechanism is activated or actuated by handles positioned at opposite end portions of an actuating mechanism for a wringer.

In another example of utility equipment, for example a wringer for mops, the equipment can have a plurality of handles having grasping portions accessible to a user, for example handles spaced upward and away from a wringer. Handle portions can be spaced apart from each other, and independently grasped by the user. Handle portions can be separated but linked in such a way that manipulation of one, of the other or of both handle portions will actuate the device, such as a wringer.

In another example of a utility device, for example a wringer, the utility device may include one or more handles for operating the device, wherein one or more of the handles have a plurality of configurations. In one configuration, for example, the handle or handles can be used to operate the utility device, and in another configuration, the handle or handles can be used to move the device from one location to another. In a further configuration, a handle can have a locked configuration for transport and/or storage.

In another configuration, handles on a mop wringer can be configured to actuate a wringer action by moving in a direction across a normal or operating zone or area of accessibility for a mop, without affecting the operation of the wringer or accessibility for the mop into the wringer area. For example, handles can be positioned on different sides of an operating zone or effective area for the wringer, and be split in such a way that operation of the handles still allows access to the operating zone or area for wringing.

These and similar configurations can also be used for wringing a mop and providing access to the contents of a bucket to which the wringer is mounted or supported without having to move or adjust the position of the wringer.

These and other examples are set forth more fully below in conjunction with drawings, a brief description of which follows.

DETAILED DESCRIPTION

Figure 1:
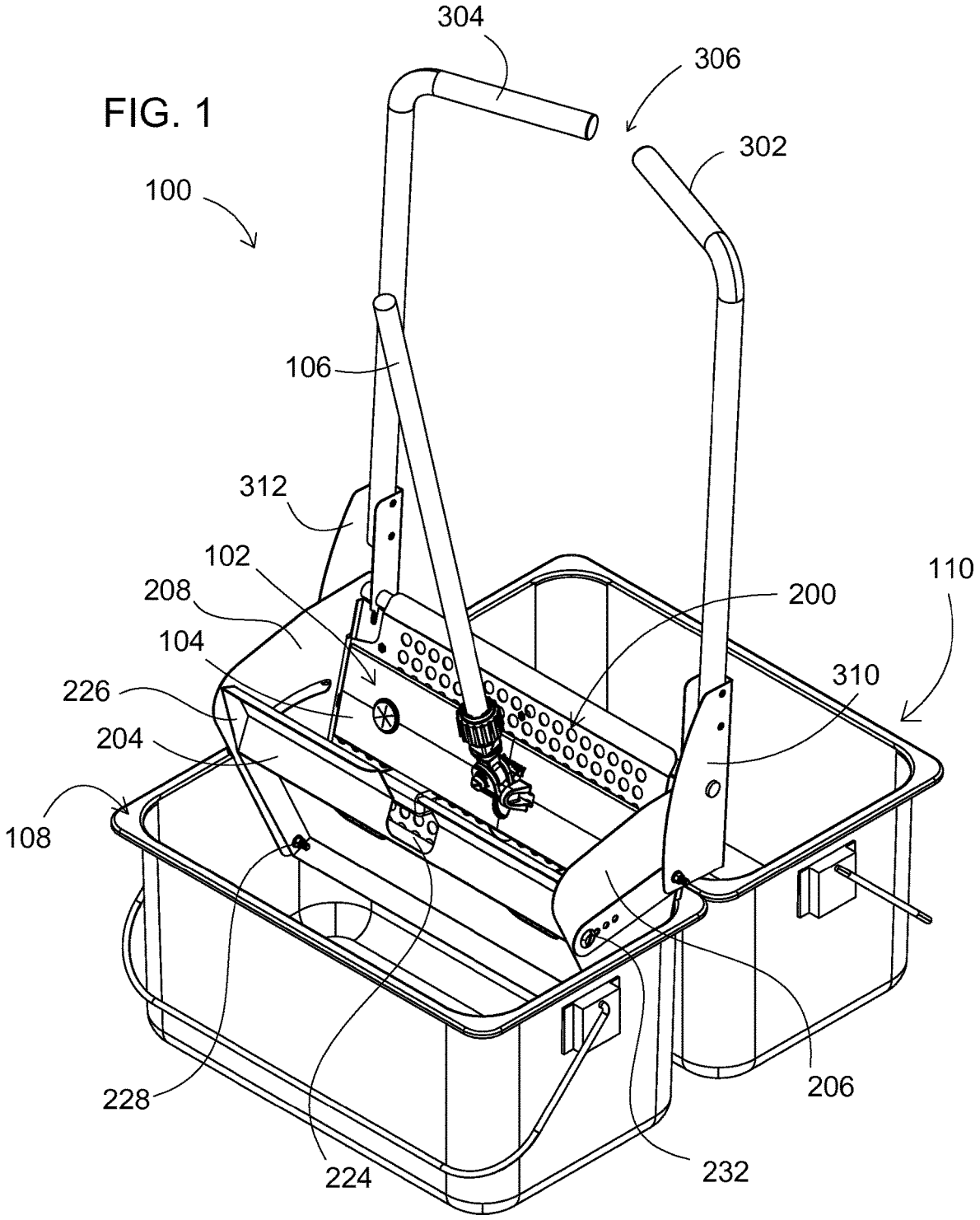
FIG. 1 is an upper isometric view of a wringer assembly supported by a double bucket system in accordance with one example of the present configurations.

This specification taken in conjunction with the drawings sets forth examples of apparatus and methods incorporating one or more aspects of the present inventions in such a manner that any person skilled in the art can make and use the inventions. The examples provide the best modes contemplated for carrying out the inventions, although it should be understood that various modifications can be accomplished within the parameters of the present inventions.

Examples of wringers and of methods of making and using the wringers are described. Depending on what feature or features are incorporated in a given structure or a given method, benefits can be achieved in the structure or the method. For example, wringers drawing pressure plates together may provide for a more stable construction. Wringers having adjustable handle configurations provide more flexibility and/or stability in use. Additionally, wringers having a plurality of handles may also provide flexibility in use. Wringers having a spaced apart or separated handle configurations may also more easily accommodate devices such as mops having extended handles, while still permitting easy access to the wringer and/or a bucket system on which the wringer is supported.

These and other benefits will become more apparent with consideration of the description of the examples herein. However, it should be understood that not all of the benefits or features discussed with respect to a particular example must be incorporated into a wringer, component or method in order to achieve one or more benefits contemplated by these examples. Additionally, it should be understood that features of the examples can be incorporated into a wringer, component or method to achieve some measure of a given benefit even though the benefit may not be optimal compared to other possible configurations. For example, one or more benefits may not be optimized for a given configuration in order to achieve cost reductions, efficiencies or for other reasons known to the person settling on a particular product configuration or method.

Examples of a number of wringer configurations and of methods of making and using the wringers are described herein, and some have particular benefits in being used together. However, even though these apparatus and methods are considered together at this point, there is no requirement that they be combined, used together, or that one component or method be used with any other component or method, or combination. Additionally, it will be understood that a given component or method could be combined with other structures or methods not expressly discussed herein while still achieving desirable results.

Flat mop wringers are used as examples of a wringer that can incorporate one or more of the features and derive some of the benefits described herein. However, other mops such as string mops and other cleaning materials can also be used with the wringers described herein.

It should be understood that terminology used for orientation, such as front, rear, side, left and right, upper and lower, and the like, are used herein merely for ease of understanding and reference, and are not used as exclusive terms for the structures being described and illustrated.

In one example, a wringer assembly 100 can be used to wring a flat mop, a string mop, loose cleaning materials or other products. In the present example described herein, the wringer 100 will be described with respect to a flat mop 102 having a mop base 104 supported by and controlled with an extended handle 106. Other mop configurations and materials can be easily accommodated in the wringer described herein, and one or more alternative configurations of the wringer can easily accommodate a flat mop such as that shown in FIGS. 1-11.

The wringer assembly 100 can be supported by one or more conventional buckets 108 and 110. In the present example illustrated in FIG. 1, the wringer is supported by a double bucket arrangement, with or without a cart, with the wringer supported over and extending into a portion of the interior of the bucket 108. In this configuration, the flat mop 102 as well as other mops can be wrung with the wringer assembly 100 and saturated or wetted with fluid contained in the bucket 108.

In the configuration of the wringer assembly 100 shown in FIGS. 1-11, the wringer assembly is actuated by pulling handles (described more fully below) in the direction of the opposite side of the bucket 108 and away from the bucket 110. In this configuration, the double bucket system and any cart or platform on which the assembly is supported better supports the wringer assembly during the wringing operation, reducing the possibility of the assembly tipping. Additionally, the wringer assembly can be positioned to one side of the bucket while leaving the opposite side open for access for the user, for example to insert into and withdraw a mop from the interior of the bucket.

The configuration of the wringer assembly and the mop in the position shown in FIG. 1 also allows the handles to be positioned or mounted on a portion of the wringer behind or outside the wringing or working area of the wringer accessible to the mop, and still allow the handles to actuate the wringer in a way that the actuation assembly with the handles does not interfere with the positioning of the mop or the mop handle. In one configuration, split or separated handles on the wringer allows the mop handle 106 to remain in a desired position during the wringing operation. Additionally, a multiple handle wringer configuration can allow either one or both handles to actuate the wringing mechanism, and split or separated handles allow the flexible wringing operation without interfering with the mop.

In one example of the wringer assembly 100 shown in FIGS. 1-11, the wringer assembly may include various arrangements for mounting the wringer assembly to a support structure, for example the buckets 108 or 110. In the present example, the wringer assembly includes a mounting bracket 112. The mounting bracket 112 is mounted to a rear outer surface of a pressure plate, in the present example a base pressure plate 202, described more fully below. The mounting bracket includes an angled or arcuate support structure 114. The support structure helps to position the wringer on the support surface such as the upper rim of a bucket, and laterally position the wringer relative to the bucket rim. The arcuate support structure 114 extends almost the entire width of the wringer.

The mounting bracket 112 is integral with or monolithic with a backplate 116. The backplate 116 is mounted to the base pressure plate 202 over a substantial vertical and horizontal distance of the base pressure plate 202. In the present example, the backplate 116 is mounted to the base pressure plate through a plurality of standoffs 118. The standoffs provide spacing between the backplate 116 and the perforated base pressure plate 202. The backplate 116 is a solid structure, without any perforations, and serves as a backsplash and channel wall to channel excess fluid down the backplate 116 and into the underlying bucket.

The wringer assembly 100 includes a wringing assembly 200 and an actuation or activation assembly 300. The wringing assembly 200 forms a cavity, depression or groove between the base pressure plate 202 and a pressing plate 204. In the present example, the base pressure plate 202 is stationary and the pressing plate 204 is movable. However, in other configurations, both can be movable. The wringing assembly also includes side supports 206 and 208. The side supports define the lateral boundaries of the wringing enclosure. The side supports are supported on the base plate 202, and may be mounted to, formed integral with or otherwise fixed to the base pressure plate 202.

In the present example, the base pressure plate 202, pressing plate 204 and the side supports 206 and 208 help to form a "structural wringing envelope". The "structural wringing envelope" in the present configuration shown in FIGS. 1-11 is a geometric volume defined by the uppermost edges of the pressure plate 202, the pressing plate 204 and of the side supports 206 and 208, and the bottoms of those structures, within which volume wringing can occur. Not all points within the structural wringing volume may be effective in wringing function, and for example a cut out in a wall of the structural wringing envelope for receiving a component of a mop may result in a portion of the structural wringing envelope being ineffective for functional wringing. In contrast to the structural wringing envelope, a "functional wringing envelope" is the functional interior surface areas that can produce a wringing function when a mop element is placed at a point within the volume of the structural wringing envelope. Therefore, there may be instances in which the volume of a structural wringing envelope is greater than the effective or functional wringing envelope volume.

The base pressure plate 202 is a substantially planar perforated plate. A mop structure is pressed against the plate, and the perforations 210 (FIGS. 12-13) help to wring the mop when the mop and the plate are pressed against each other. A plurality of openings 212 allow the base pressure plate 202 to be mounted through the standoffs to the base plate 116. A substantially central opening 214 provides a gap, space or cavity for receiving a portion of the hardware of the mop structure, for example a nut or other protrusion on the mop assembly, thereby allowing more reliable contact between the mop and the base pressure plate 202 without substantial interference from protruding or obstructing components.

Figure 11:
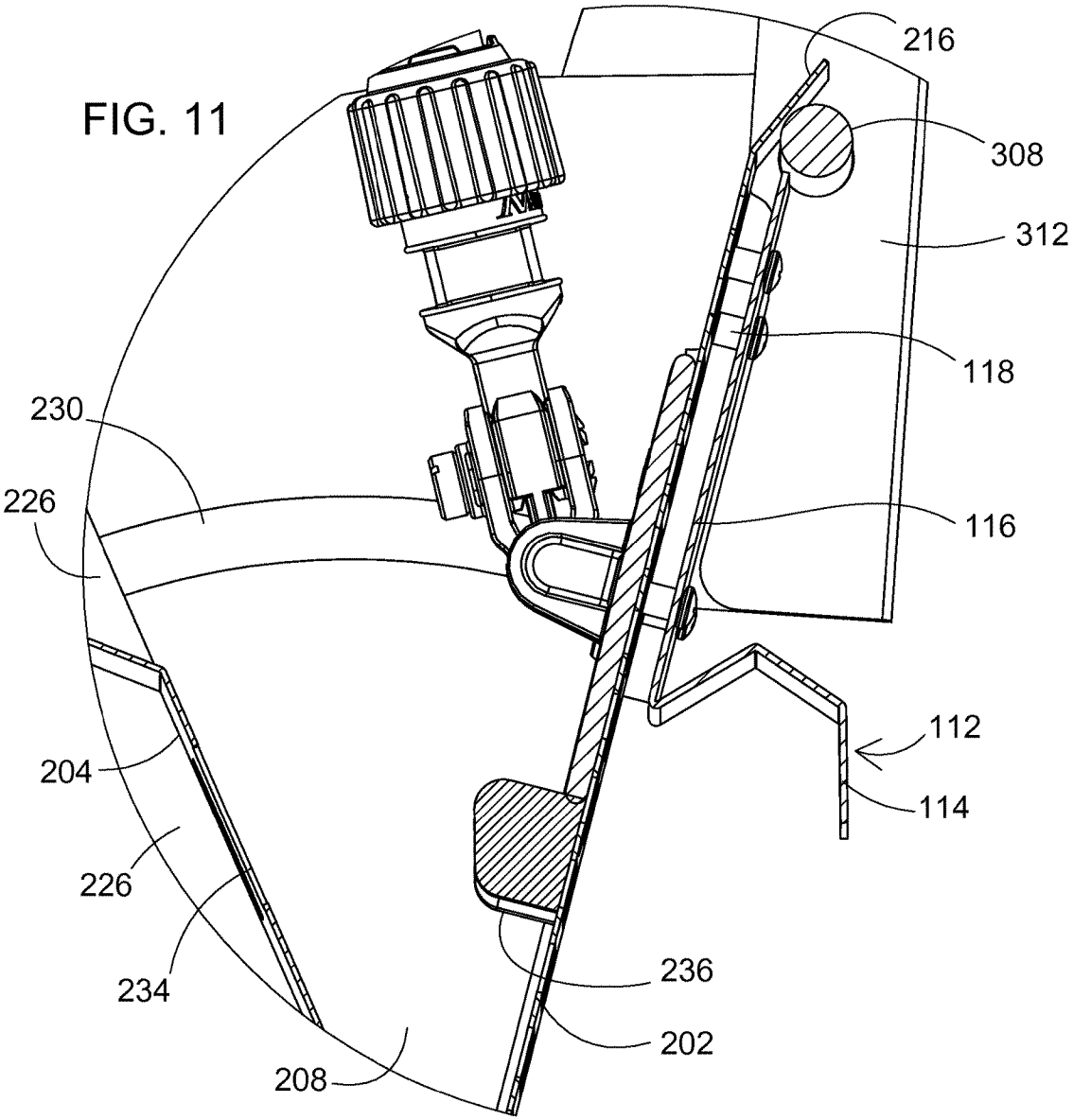
FIG. 11 is a detail of a portion of the wringer assembly of FIG. 1 and a mop taken at "11" of FIG. 10.
Figure 12:
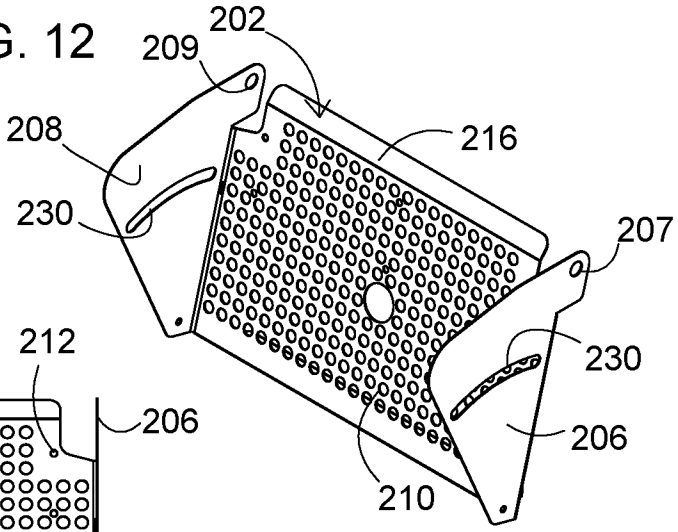
FIG. 12 is an upper right isometric view of a base plate of the wringer of FIG. 1.
Figure 13:
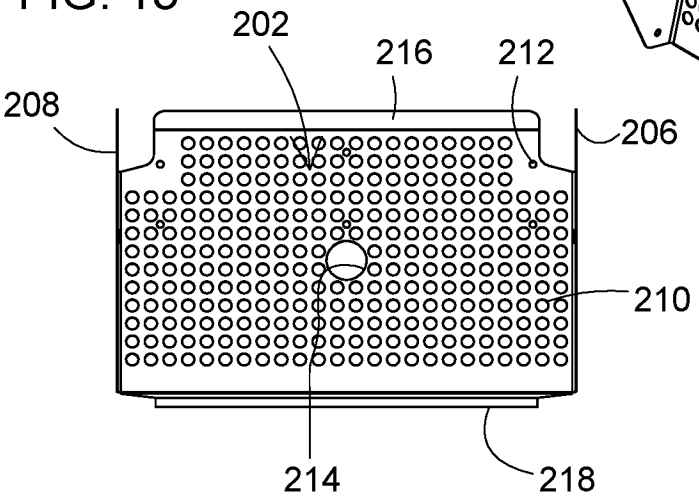
FIG. 13 is a front elevation view of the base plate of FIG. 12.
Figure 14:
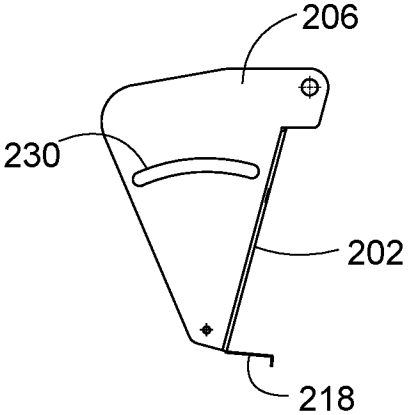
FIG. 14 is a right side elevation view of the faceplate of FIG. 12.
Figure 15:
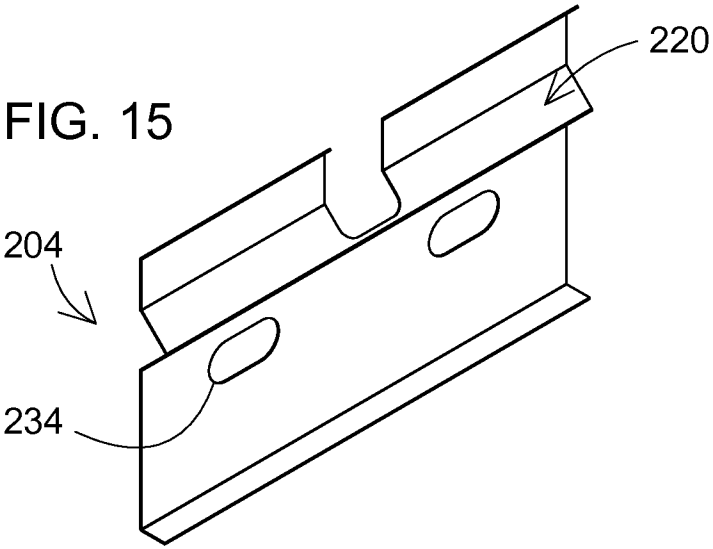
FIG. 15 is a front left isometric view of a press plate of the wringer of FIG. 1.
Figure 16:
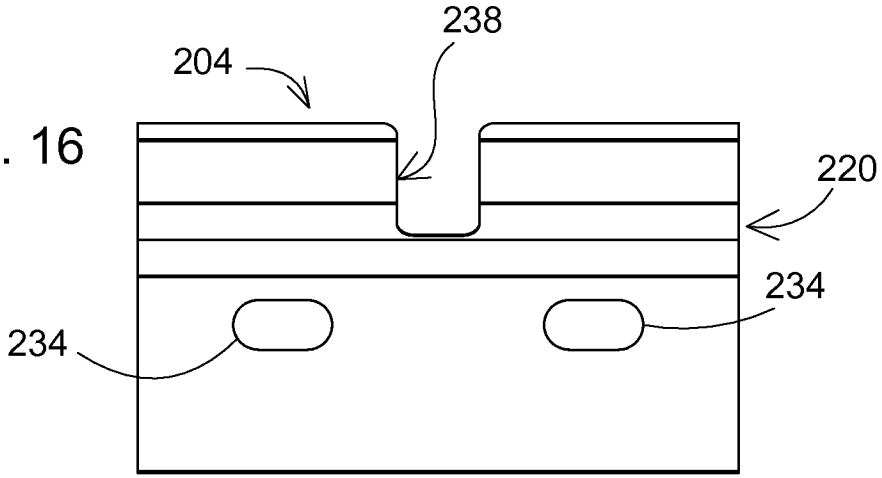
FIG. 16 is a front elevation view of the press plate of FIG. 15.
Figure 17:
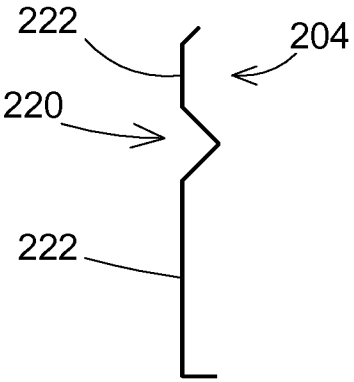
FIG. 17 is a left side elevation view of the press plate of FIG. 15.

The base pressure plate 202 may include a flange plate 216 (FIGS. 11-13). The flange plate 216 helps to guide the mop into the wringing cavity and reduce splashing outside the bucket 108. A support flange 218 helps to support the wringer assembly against an interior wall of the bucket 108.

The press plate 204 in the present example is a substantially unperforated plate (FIGS. 1, 2-8 and 15-17). In the illustrated example, the press plate 204 includes a laterally extending channel 220 recessed below the working surface 222 of the press plate. The channel 220 receives a mounting bar 224 (FIGS. 1 and 10) that supports the press plate in the wringing assembly. The channel 220 also provides a recess for accommodating any hardware, such as mop hardware, that might reduce the effectiveness of the wringing action. The press plate 204 in the present example also includes side mounting plates 226 at each lateral side of the press plate to help mount and support the press plate in the wringing assembly. The mounting bar 224 passes through openings in the side mounting plates so that movement of the mounting bar will move the press plate 204. The side mounting plates and therefore the press plate are mounted pivotally to the respective side plates 206 and 208 through fasteners 228. The upper portion of the press plate is supported in grooves 230 in the side plates 206 and 208 through the rod 224 extending in the recess 226 through the plates 226 and through the grooves 230 and fastened in place and secured for arcuate movement in the grooves 230 by fasteners 232.

In one configuration of the press plate 204, the press plate can include one or more openings 234. In the present example, the press plate includes two openings having an oval shape. The openings receive a respective number of positioning elements, in the present example press blocks 236 mounted on, secured to or formed in the base pressure plate 202. As shown in FIG. 11, a flat mop placed against the base pressure plate 202, for example resting on the press blocks 236, will be pressed against the pressure plate 202 by the press plate 204 after the press blocks 236 have passed through the openings 234. In a typical operation, the flat mop is positioned against the base plate and on the press blocks 236 in the orientation shown in FIG. 11. The handle or other support structure of the mop assembly would fit through the opening 238 in the top surface of the press plate 204, thereby allowing the press plate to make contact with the back surface of the flat mop head. Typically, positioning elements would be mounted within the structural wringing envelope, but it is possible a positioning element can be located outside the structural wringing envelope and used in such a way as to position, suspend or otherwise locate a mop element at a desired location in the functional wringing envelope.

In an alternative configuration, if the mop assembly were reversed relative to the pressure plate and press plate, the working surface of the flat mop is placed against the interior surface of the press plate 204. As there is no stop surface on the press plate 204 limiting the downward movement of the flat mop along the surface of the press plate 204, the flat mop may extend further downward into the cavity between the pressure plate 202 and the press plate 204 than the position shown in FIG. 11. To wring the flat mop, the press plate is closed toward the pressure plate 202, and the press blocks 236 bear against the backside of the flat mop head, thereby pressing the opposite surfaces of the flat mop and the press plate against each other, thereby wringing the flat mop. Alternatively, if the flat mop is positioned in the cavity between the pressure plate 202 and the press plate 204 higher than the press blocks 236, the press blocks will fit into the openings 234, and the press plate 204 will continue closing against the flat mop to press the flat mop and the press plate against each other. The press plate 204 moves toward and away from the pressure plate 202 through action of the actuation assembly 300. Fluid wrung from the mop assembly flows through the perforations in the pressure plate 202 and also out through the bottom of the wringing cavity through a gap between the pressure plate 202 and the press plate 204.

The relative positions of the pressure plate and the press plate, and the spacing at the bottoms of those two plates also permit string mops and other mop and wiping materials to be wrung in the wringer.

The actuation assembly 300 in the present example includes at least one handle, and in the present example first and second laterally spaced apart handles 302 and 304. In the present example, a pair of handles is included so that the wringing assembly can be actuated through either handle, from either side of the wringing assembly. Also in the present example, the actuation assembly is positioned relative to the wringing assembly outside the wringing area, and behind the wringing assembly relative to the opening in the bucket. This positioning allows greater stability during the wringing action, and positioning of the handles further from the perimeter areas of the bucket assembly. In a double bucket assembly, the handles can be positioned in a center area of the assembly, and the handles pulled across one of the buckets to actuate the wringing of a mop. In the present example, horizontally extending handle portions extend in different directions, non-parallel to each other. A gap 306 can be included between the handles to provide clearance for the extended mop handle 106. The gap 306 in one configuration is at least the handle diameter or maximum width of the mop used with the wringer, and can be at least one half inch or 1 inch and as high as 4-6 inches or more. The gap 306 is considered to be the spacing when the handle ends are at their closest, and can be selected to be sufficiently small as to allow the handle ends to pass one another, and a mop handle can pass between the ends when the handles are offset from each other, for example due to tolerances and mechanical looseness in the parts. As a result, the handles can be moved to wring the mop even while the extended handle of the mop is extending upward.

Figure 10:
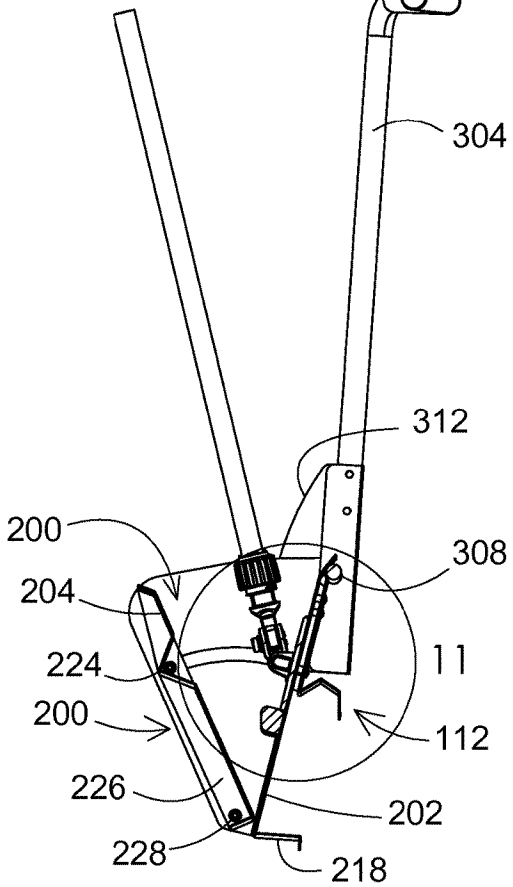
FIG. 10 is a right sagittal section of the wringer assembly of FIG. 1.

The actuation assembly 300 is mounted for pivoting action to the side plates 206 and 208 by a pivoting shaft 308 (FIGS. 10-11). The shaft 308 is pivotably mounted through the side plates 206 and 208 through side plate openings 207 and 209, respectively (FIG. 12). The handles 302 and 304 pivot around the pivoting shaft 308 to carry out the wringing action. The handles are mounted to the pivoting shaft through respective lever plates or lever linkages 310 and 312. In the present configuration, the lever plates are U-shaped channels having side plates extending in two directions, upwardly (in the views shown in the Figures) to receive and secure the handles, and laterally to receive and secure press linkages to the press plate 204. The upward and lateral directions provide a moment arm for moving the press linkage upon the movement of the handles 302 and/or 304.

Figure 2:
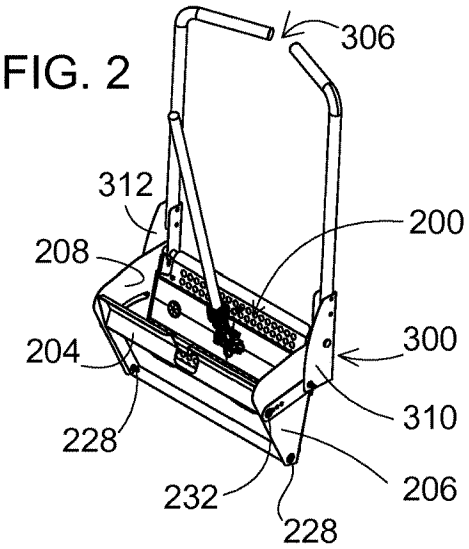
FIG. 2 is an upper right isometric view of the wringer assembly of FIG. 1.
Figure 3:
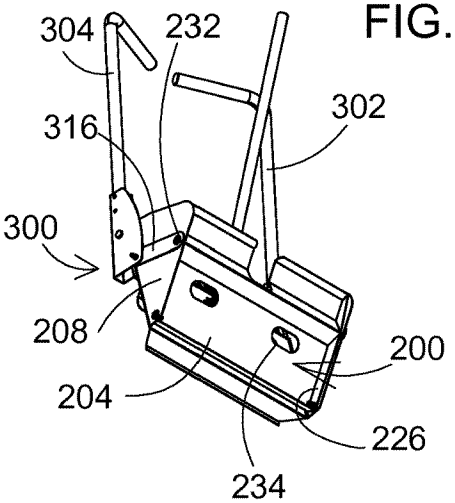
FIG. 3 is a lower left isometric view of the wringer assembly of FIG. 1.
Figure 7:
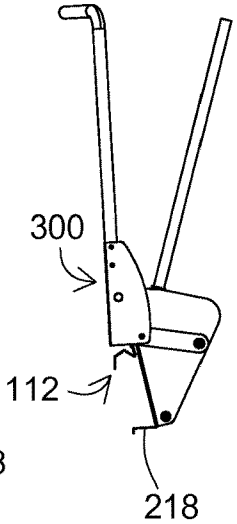
FIG. 7 is a left side elevation view of the wringer assembly of 1.
Figure 5:
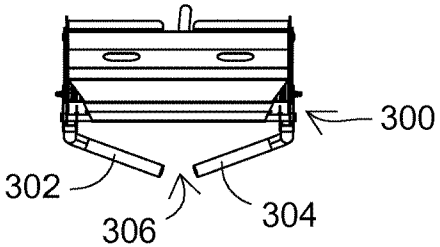
FIG. 5 is a bottom plan view of the wringer assembly of FIG. 1.
Figure 4:
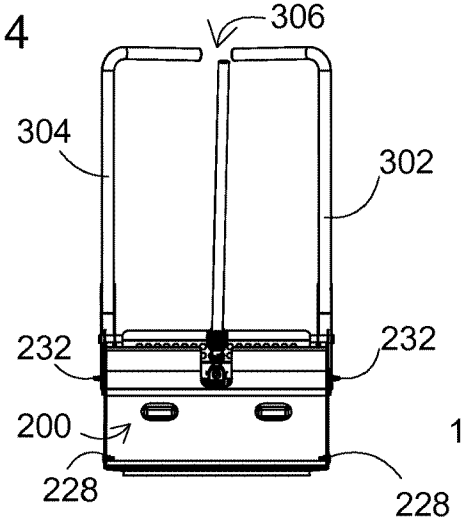
FIG. 4 is a front elevation view of the wringer assembly of FIG. 1.
Figure 8:
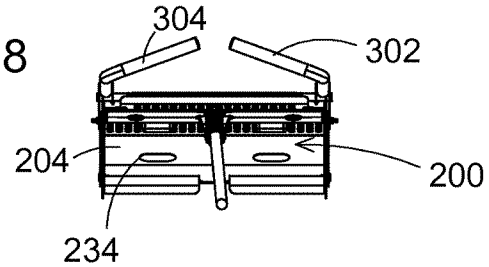
FIG. 8 is a top plan view of the wringer assembly of FIG. 1.
Figure 6:
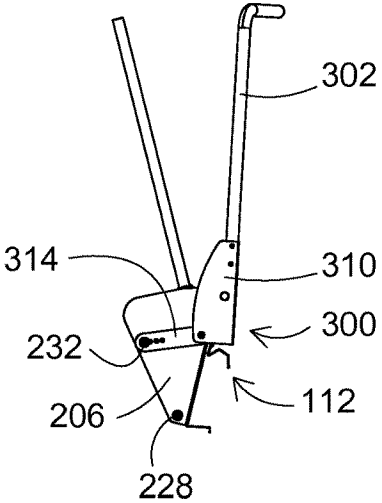
FIG. 6 is a right side elevation view of the wringer assembly of FIG. 1.
Figure 9:
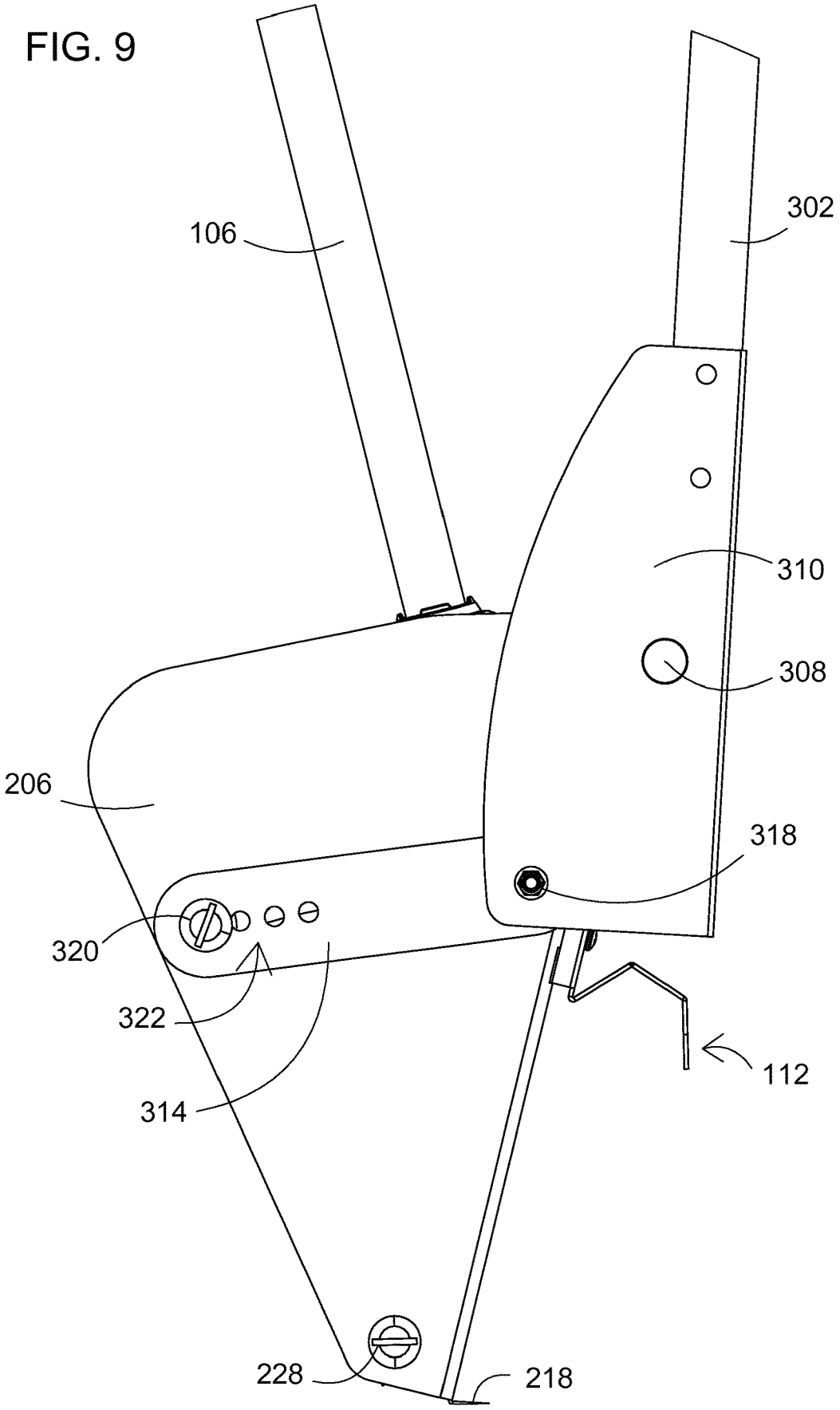
FIG. 9 is a detail and right side elevation view of a portion of the wringer assembly of FIG. 1.

The lever linkages 310 and 312 pivotably couple respective press linkages 314 and 316 (FIGS. 2, 6 and 9). The respective press linkages 314 and 316 are pivotably coupled to lever linkages 310 and 312 through respective fasteners 318 and to the rod 224 through respective fasteners 320. Actuation of the handles 302 and 304, for example in the view shown in FIG. 9 counterclockwise and over the wringer and across and past the press plate 204, pivots the linkages 310 about the pivoting shaft 308. The linkages through fasteners 318 pivot counterclockwise, to the right in the view shown in FIG. 9, and draw the linkages 314 and 316 to the right (as viewed in FIG. 9). The rod 224 draws the press plate 204 toward the pressure plate 202 as the rod translates through the arcuate grooves 230. Releasing the handles or moving the handles back toward their upright positions shown in FIG. 1 reverses the travel of the apparatus.

The press linkages 314 may include multiple openings 322 for positioning the press plate in a desired resting position by way of positioning the rod 224. In a more closed position or configuration, the wringer assembly can be configured to wring only flat mops. In a more open position or configuration, the wringing assembly can be configured to wring not only flat mops but also other mop configurations.

A detent, a lock or latch mechanism can be incorporated into the actuation assembly to lock the handles in a desired position or positions. For example, the handles can be locked in a down or downward position relative to that shown in FIG. 1, for example for pushing the assembly from one location to another. Other configurations may be incorporated in the apparatus.

Having thus described several exemplary implementations, it will be apparent that various alterations and modifications can be made without departing from the concepts discussed herein. Such alterations and modifications, though not expressly described above, are nonetheless intended and implied to be within the spirit and scope of the inventions. Accordingly, the foregoing description is intended to be illustrative only.

What is claimed is:

1. A wringer comprising a wringing mechanism having at least first and second wringing elements having respective wringing surfaces and an actuating mechanism positioned closer to the second wringing element than to the first wringing element, and wherein the first wringing element is movable toward and away from the second wringing element, wherein the actuating mechanism includes a pivoting element that can be caused to pivot by a plurality of pivot elements positioned at two different locations on the wringer and further including handles coupled to respective ones of the pivot elements and wherein the actuating mechanism can be actuated independently by any one of the handles.

2. The wringer of claim 1 wherein the pivoting element includes a shaft on a side of the second wringing element opposite the first wringing element.

3. The wringer of claim 1 wherein the plurality of pivot elements are positioned at respective ends of the pivoting element.

4. The wringer of claim 1 wherein at least one of the pivot elements is coupled to the first wringing element.

5. The wringer of claim 1 wherein the handles are spaced apart from each other.

6. The wringer of claim 1 wherein the handles extend upward when the actuating mechanism is not actuated, and the handles extend across the first wringing element when the actuating mechanism is actuated.

7. The wringer of claim 1 wherein the handles include respective handle ends facing in at least partly opposite directions and spaced apart from each other.

8. The wringer of claim 7 wherein the handle ends are spaced apart from each other at least a half inch.

9. The wringer of claim 1 wherein the wringer is a press wringer.

10. The wringer of claim 1 wherein at least one of the first and second wringing elements is perforated.

11. The wringer of claim 1 wherein the wringing mechanism includes first and second side plates having respective slots, and wherein portions of the first wringing element extend into respective slots on the side plates.

12. The wringer of claim 11 wherein the first and second side plates are fixed relative to the second wringing element.

13. The wringer of claim 1 wherein the actuating mechanism includes at least one linkage between the actuating mechanism and the first wringing element.

14. The wringer of claim 1 wherein the first wringing element is pivotable about a first pivot axis.

15. The wringer of claim 1 further including at least one positioning element supported on the second wringing element and positioned between the first and second wringing elements.

16. The wringer of claim 1 further including at least one support element on the wringer adjacent the second wringing element.

17. The wringer of claim 6 wherein a vertical plane intersects both the at least one support element and the pivoting element.

18. The wringer of claim 1 wherein the first wringing element includes a plurality of openings through an interior portion of the first wringing element, and a cut out in an upper portion of the first wringing element.

19. A wringer according to claim 1 wherein the first wringing element is movable in a first direction toward the second wringing element and wherein at least one handle moves in a second direction toward the first wringing element and away from the second wringing element when the first wringing element is moved in the first direction.

20. The wringer of claim 19 wherein the handles pivot about a pivot axis closer to the second wringing element than to the first wringing element.

21. The wringer of claim 20 wherein the pivot axis is on a side of the second wringing element opposite the first wringing element.

22. A wringer according to claim 1 wherein the wringing mechanism includes the first and second wringing elements wherein the first wringing element is movable toward the second wringing element, and wherein the handles comprise at least two handles wherein either of the two handles is configured to actuate the wringing mechanism to move the first wringing element.

23. The wringer of claim 22 wherein the handles are spaced apart from each other.

24. The wringer of claim 22 wherein the handles are first and second handles coupled on opposite ends of a pivot shaft.

25. A wringer according to claim 1 wherein at least one of the first and second wringing elements includes a surface extending laterally of the wringing element to lateral edges and an opening in the surface between the lateral edges for receiving a structure on a mop or on the other of the first and second wringing elements.

26. The wringer of claim 25 wherein the opening defines a cavity having a depth sufficient to receive the structure on a mop or on the other of the first and second wringing elements.

27. The wringer of claim 25 wherein the at least one wringing element is a movable wringing element.

28. The wringer of claim 25 wherein the opening is a hole.

29. The wringer of claim 25 wherein the opening is cut into an edge of the at least one wringing element.

30. A wringer comprising a wringing mechanism having at least first and second wringing elements having respective wringing surfaces and an actuating mechanism positioned closer to the second wringing element than to the first wringing element, and wherein the first wringing element is movable toward and away from the second wringing element, wherein the second wringing element includes a wringing surface and wherein the wringer further includes a housing adjacent the wringing surface, wherein the wringing surface and the housing define a wringing envelope, wherein the wringing envelope includes a lower-most surface that a mop element within the wringing envelope can contact, and wherein at least one of the wringing surface and a surface on the housing within the wringing envelope includes at least one positioning element having a surface opposite the lower-most surface, and wherein the at least one positioning element is sized sufficiently to be contacted by a mop element such that the positioning element limits the movement of the mop element toward the lower-most surface.

31. The mop wringer of claim 30 wherein the wringing surface is a perforated plate.

32. The mop wringer of claim 30 wherein the positioning element is mounted to the wringing surface.

33. The mop wringer of claim 30 wherein the at least one positioning element is a plurality of positioning elements.

34. The mop wringer of claim 30 further including a support element mounted adjacent the wringing surface for supporting the mop wringer on a support structure.

35. The mop wringer of claim 30 wherein the first wringing element includes a movable pressing surface configured to move toward the wringing surface.

36. The mop wringer of claim 35 wherein the movable pressing surface includes a recessed surface for receiving a structure on a mop.

37. The mop wringer of claim 35 wherein the movable pressing surface includes a gap through which a portion of a mop can extend.

38. The mop wringer of claim 30 wherein the actuating mechanism includes spaced apart handles.

39. The mop wringer of claim 38 wherein the actuating mechanism is configured such that movement of a single handle of the spaced apart handles can actuate the wringer.

40. A wringer according to claim 30 wherein the first wringing element is movable in a first direction toward the second wringing element and wherein the actuating mechanism includes a handle for actuating the wringing mechanism wherein the handle moves in a second direction toward the first wringing element and away from the second wringing element when the first wringing element is moved in the first direction.

41. The wringer of claim 40 wherein the handle pivots about a pivot axis closer to the second wringing element than to the first wringing element.

42. The wringer of claim 41 wherein the pivot axis is on a side of the second wringing element opposite the first wringing element.

43. A method of operating a wringer assembly wherein the wringer assembly includes a wringer actuating mechanism having at least one handle, wherein the wringer assembly further includes first and second wringing surfaces and wherein a portion of the wringer actuating mechanism is mounted adjacent the second wringing surface, wherein the method includes actuating the wringer actuating mechanism by moving the at least one handle through a space used to place a mop between the first and second wringing surfaces and while moving the first wringing surface toward the second wringing surface, wherein moving the at least one handle includes moving the at least one handle from one side of a mop handle to another side of the mop handle, and further including a second handle for actuating the wringer actuating mechanism and moving the at least one handle and the second handle on opposite sides of the mop handle.

44. The method of claim 43 further including moving the first handle further away from the second wringing surface and closer to the first wringing surface.

45. A method of moving a wringer assembly wherein the wringer assembly includes a wringer actuating mechanism and a handle for operating the actuating mechanism, wherein the handle has a first position where the actuating mechanism is unactuated, and a second position where the actuating mechanism is at least partly actuated, the method including moving the handle between the first position and a second position, and moving the wringer when holding the handle while the handle is in the second position and wherein the handle is a first handle and further including a second handle spaced apart from the first handle and wherein moving the handle between the first position and the second position includes moving the first and second handles on opposite sides of a mop handle.

46. The method of claim 45 further including securing the first handle in the second position.

47. The method of claim 45 further including locking the first handle in the second position.

* * * * *